US011597565B2

(12) United States Patent
Hart

(10) Patent No.: US 11,597,565 B2
(45) Date of Patent: Mar. 7, 2023

(54) METHOD AND APPARATUS FOR SEALING A BAG OPENING

(71) Applicant: Madeline B. Hart, Riviera Beach, FL (US)

(72) Inventor: Madeline B. Hart, Riviera Beach, FL (US)

( * ) Notice: Subject to any disclaimer, the term of this patent is extended or adjusted under 35 U.S.C. 154(b) by 247 days.

(21) Appl. No.: 17/070,093

(22) Filed: Oct. 14, 2020

(65) Prior Publication Data

US 2022/0112001 A1 Apr. 14, 2022

(51) Int. Cl.
*B65D 33/16* (2006.01)
*B65B 7/06* (2006.01)

(52) U.S. Cl.
CPC ..... *B65D 33/1666* (2013.01); *B65B 7/06* (2013.01)

(58) Field of Classification Search
CPC .. B65D 33/1666; B65D 33/1675; B65B 7/06; Y10T 24/15
See application file for complete search history.

(56) References Cited

U.S. PATENT DOCUMENTS 5,138,750 A 8/1992 Gundlach
D331,364 S * 12/1992 Barker ..... D9/434
5,983,460 A * 11/1999 Hyde ..... B65D 33/1666 24/561
D474,968 S * 5/2003 Hicks ..... D9/443
7,503,696 B2 * 3/2009 Ha ..... B65D 33/02 24/30.5 R
8,443,494 B2 * 5/2013 Sharp ..... H01F 7/0263 24/3.12
2009/0056081 A1 * 3/2009 Lin ..... B65F 1/06 24/30.5 R
2009/0211059 A1 * 8/2009 Byron ..... B65D 33/1666 24/30.5 R

* cited by examiner

*Primary Examiner* — Andrew M Tecco
*Assistant Examiner* — Nicholas E Igbokwe
(74) *Attorney, Agent, or Firm* — Rossi, Kimms & McDowell LLP

(57) ABSTRACT

An apparatus for sealing a bag opening includes a retaining member and a slide member adapted to slide into said retaining member. The retaining member includes an elongated opening that extends through at least one open end of the retaining member. A bottom stop is provided at an end of the retaining member that is opposite to the open end of the retaining member. Alternatively, the retaining member includes an elongated opening that extends through both ends of the retaining member and the bottom stop is omitted. The slide member includes at least one protruding portion that protrudes from the retaining member when the slide member is slid into and retained by the retaining member. The slide member abuts the bottom stop of the retaining member when such bottom stop is provided within the retaining member. In cases in which the retaining member is provided with two open ends, the slide member may include two protruding portions that protrude from both open ends of the retaining member.

1 Claim, 4 Drawing Sheets

METHOD AND APPARATUS FOR SEALING A BAG OPENING

BACKGROUND OF THE INVENTION

The present invention relates generally to methods and devices for sealing containers. More specifically, the present invention relates to a method and apparatus for sealing a bag opening.

Modern methods of packaging, storing and marketing a variety of consumable food products has led to an explosion in the use of hermetically sealed bags in the grocery industry. The use of such bags enables manufacturers to provide consumers with a variety of food products having long duration shelf lives and different portion sizes. Once opened by the consumer, however, the product retained in an open bag can begin to degrade rapidly due to exposure to air. Product degradation may occur, for example, due to microbial agents or by atmospheric conditions, such as humidity levels, which might be detrimental to the product contained in the opened bag. Accordingly, in order to avoid spoilage, one must either transfer any unused product from the opened bag to a sealable container or find a way of resealing the bag that prevents, at least to some degree, the penetration of air and subsequent degradation of the product.

One approach to solving the bag resealing problem is to provide the product bag itself with a resealable closure. U.S. Pat. No. 5,138,750 issued to Gundlach et al., for example, illustrates a bag closure structure operated by pressing the opposite sides of a mouth of a bag together. The user squeezes the opposite sides of the mouth together typically with their thumb and index finger and slides their thumb and index finger along the mouth of the bag so that a cooperating interlocking coupling structures are engaged together to form a seal. Once sealed, the mouth of the bag can be reopened by gripping and pulling opposite sides of the mouth of the bag apart to release the interlocking coupling structures. Anyone that has used such a bag closure structure, however, is well aware of how difficult it can sometimes be to properly align the interlocking coupling structures and maintain the alignment while squeezing and sliding the thumb and index finger over them to form a seal. Such bag closure structures also have a tendency to come open under various conditions such as storage in a freezer. Further, the addition of a bag closure structure to the bag itself increases the cost of manufacturing the bag.

An alternative approach to providing a bag closure structure in the structure of the bag itself is to utilize a separate sealing mechanism that can be used to close the open mouth of the bag. A typical example of a separate sealing mechanism is a spring loaded clamping device having a pair of spring loaded elongated jaws that clamp two sides of the opened mouth of a bag closed. Spring loaded clamping devices, however, are usually limited in size and may not seal the entire length of the mouth of the bag. Further, the spring loaded clamping devices are not easily stackable or storeable and take up an inordinate amount of storage space in kitchen drawers designed to store utensils. The spring loaded clamping devices are also generally composed of multiple pieces which much be assembled adding to their expense.

In order to overcome the problems associated with spring loaded clamping devices, U.S. Patent Application Publication 2009/0211059 A1 filed by Byron et al. discloses a sealing device which includes a receiver portion and a sealing portion as shown in FIGS. 9 and 10 therein. The sealing portion is removably retained within an engagement aperture provided in the receiver portion when the sealing portion is inserted into the receiver portion. At least one of the sealing portion and the receiver portion are formed of an semi-rigid material. In operation, the sealing portion is impressed into an opening in the receiver portion and moves into the engagement aperture with a portion of the bag next to the open mouth threaded between the sealing portion and the receiver portion. Essentially, it can be said that the sealing portion and the receiver portion mechanically clip or snap together and capture the mouth of the bag between them as the sealing portion is snapped into the receiver portion.

While the device illustrated in Byron et al. may provide some advantages over the spring loaded clamping devices discussed above, the device of Bryon et al. also suffers from certain disadvantages and deficiencies. Primary among such disadvantages and deficiencies is the necessity of applying a uniform force across the sealing portion in order to clip and snap the sealing portion into the receiving portion. The application of such force can be difficult for individuals lacking in manual dexterity. Elderly individuals or those suffering from arthritis, for example, may have difficulty fitting and snapping the sealing portion into the receiving portion. Further, since the device relies on the flexibility of at least of the sealing portion and receiving portion to enable the click fit by gripping surfaces described in Byron et al., the continued use of the device over time may lead to a situation in which the seal becomes less air tight due to the stretching or deformation of the receiving portion after multiple uses.

Accordingly, in view of the above, it would be desirable to provide a method and apparatus for sealing a bag opening that can be applied to a variety of bags in a convenient and easily attachable way such that an effective seal of the bag opening is maintained. Further, it would be desirable to provide a method and apparatus for sealing a bag opening in which the sealing device would not degrade in usefulness over time. It would still further be desirable to provide an apparatus for sealing a bag opening that is simple in design and inexpensive to produce.

SUMMARY OF THE INVENTION

A method and apparatus for sealing a bag opening is described that can be applied to a variety of differently sized bags in a convenient and easily attachable way, such that an effective seal of the bag opening is maintained to preserve contents contained therein. The sealing apparatus does not require flexible structures that might degraded over time, and is of a simple design that can be inexpensively produced.

The sealing apparatus includes a retaining member and a slide member adapted to slide into said retaining member. The retaining member includes an elongated opening that extends through at least one open end of the retaining member. A bottom stop is provided at an end of the retaining member that is opposite to the open end of the retaining member. Alternatively, the retaining member includes an elongated opening that extends through both ends of the retaining member and the bottom stop is omitted. The slide member includes at least one protruding portion that protrudes from the retaining member when the slide member is inserted into and retained by the retaining member. The slide member abuts the bottom stop of the retaining member when such bottom stop is provided within the retaining member. In cases in which the retaining member is provided with two open ends, the slide member may include two protruding portions that protrude from both open ends of the retaining member. The sealing apparatus may further be provided with an engagement mechanism that releaseably couples the slide member to the retaining member when the slide member is inserted into and retained by the retaining member. In one illustrated example, the engagement mechanism includes a magnet provided on at least one of the slide member and the retaining member that is attracted to a magnetic retainer provided on the opposite member.

In operation, the slide member of the sealing apparatus is placed proximate to and just below an unsealed end of a bag, such that an end portion of the bag can be wrapped around the slide member. The slide member is then inserted into the retaining member while the end portion of the bag remains wrapped around the slide member. After the slide member is fully inserted into the retaining member, the end portion of the bag is captured and retained between the slide member and the retaining member to form a substantially air tight seal. The provision of the slot in the retaining member provides clearance for the bag as the slide member is inserted into the retaining member. The bag is reopened simply by grasping the protruding portion of the slide member and pulling the slide member out of the retaining member. Since no clamping, clipping or snapping is required by inserting the slide member into the retaining member, the sealing apparatus can be easily utilized by individuals lacking in manual dexterity.

Additional objectives, features, advantages and modifications of the invention will become apparent to one of ordinary skill in the art with reference to the following detailed description of the invention and the accompanying drawings.

DESCRIPTION OF THE DRAWINGS

The invention will be described in greater detail below with reference to certain illustrating examples and embodiments with reference to the following drawings wherein.

DETAILED DESCRIPTION OF THE INVENTION

Figure 1:
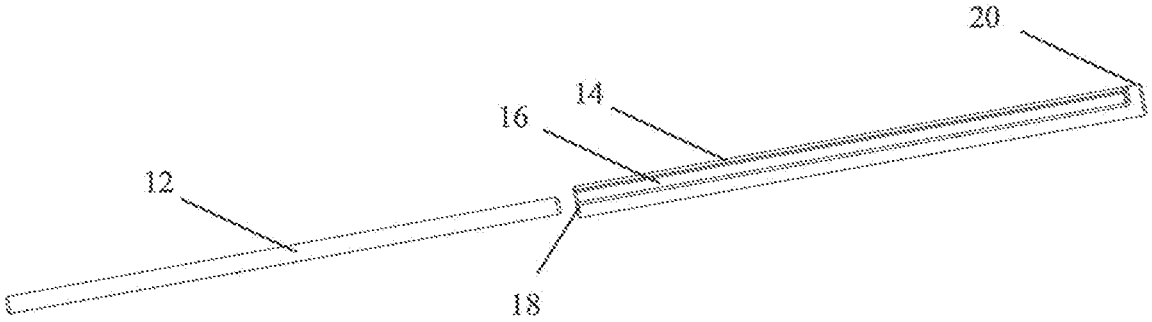
FIG. 1 is an exploded view of a sealing apparatus in accordance with the invention including a slide member and a retaining member.

Referring now to FIG. 1, a sealing apparatus 10 is shown which includes a slide member 12 and a retaining member 14. In the illustrated example, the retaining member 14 is formed substantially in the shape of a hollow cylinder which includes a bottom stop 20. An elongated opening in the form of a slot 16 is cut into the side of the retaining member 14. The slot 16 extends through at least one open end 18 of the retaining member 14 to the bottom stop 20. The slide member 12 is configured to slide into the retaining member 14 through the open end 18. Accordingly, in the example illustrated in FIG. 1, the slide member 12 takes the form of a cylindrical rod that fits within the hollow cylindrical body of the retaining member 14 and abuts the bottom stop 20 when fully inserted into the retaining member 14. The slide member 12 is sized to provide sufficient clearance for easy movement into and out of the retaining member 14 when an open mouth of a bag is wrapped around the slide member 12 as will be described in greater detail below. The slide member 12 and retaining member 14 may be constructed of a variety of materials including, but not limited to, plastics, metal, wood, ceramics and glass.

Figure 2:
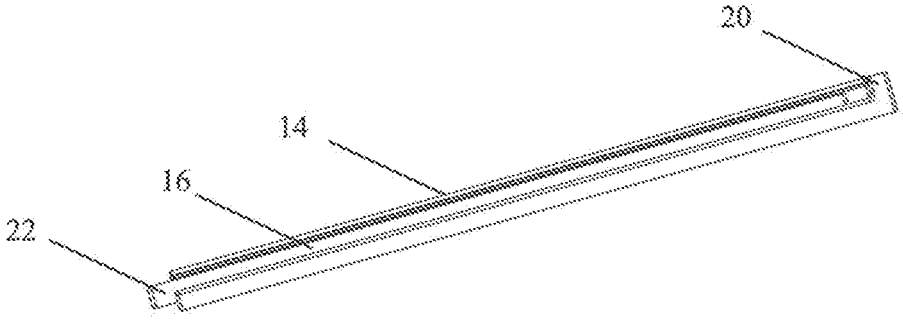
FIG. 2 is an illustration of the sealing apparatus shown in FIG. 1 when the slide member is inserted within the retaining member.

As shown in FIG. 2, It is preferable that the length of the slide member 12 be longer than the length of the retaining member 14, such that a protruding portion 22 of the slide member 12 protrudes from the open end 18 of the retaining member 14 when the slide member 12 is inserted into the retaining member 14 and abuts the bottom stop 20. The protruding portion 22 of the slide member 12 makes it easier to grasp and pull the slide member 12 out of the retaining member 14 to remove the sealing apparatus 10 from a bag. If so desired, however, the slide member 12 may be sized to be inserted completely within the retaining member 14. In such case, the slide member 12 can be easily removed by inserting a finger or thumb in the slot 16 and pushing the slide member 12 out of the retaining member 14.

Figure 3:
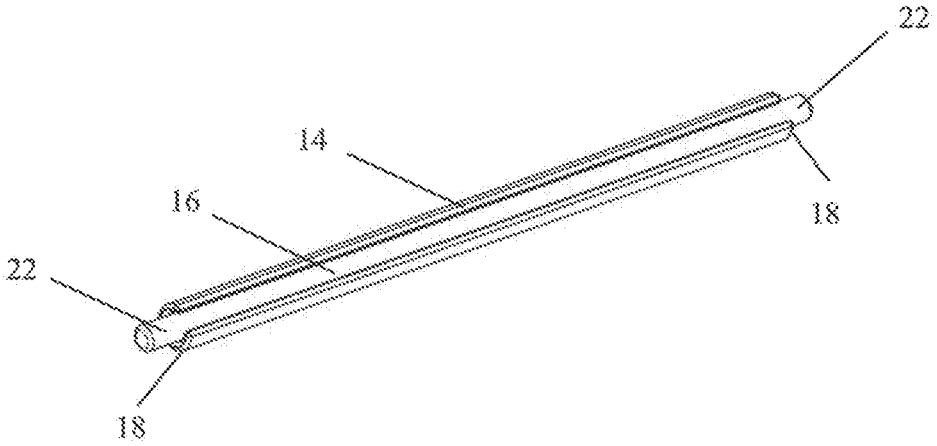
FIG. 3 is an illustration of a further example of the invention in which the retaining member is provided with two open ends.

In a further example of the invention, the retaining member 14 may be constructed without the bottom stop 20 such that the retaining member 14 has two open ends 18 as illustrated in FIG. 3. In such a case, it would also be preferable to extend the slot 16 through the entire length of the retaining member 14. As will be understood from the following discussion of the operation of the sealing apparatus 10 provided below, extending the slot 16 through the entire length of the retaining member 14 will allow the slide member 12 to be inserted into either open end 18 of the retaining member 14 when a portion of a bag is wrapped around the slide member 12. Again, the slide member 12 is preferably formed of a length to have a protruding portion 22 extending from at least one open end 18 of the retaining member 14, but it may also be formed such a protruding portion 22 is provided at both open ends 18 of the retaining member as shown in FIG. 3.

Figure 4:
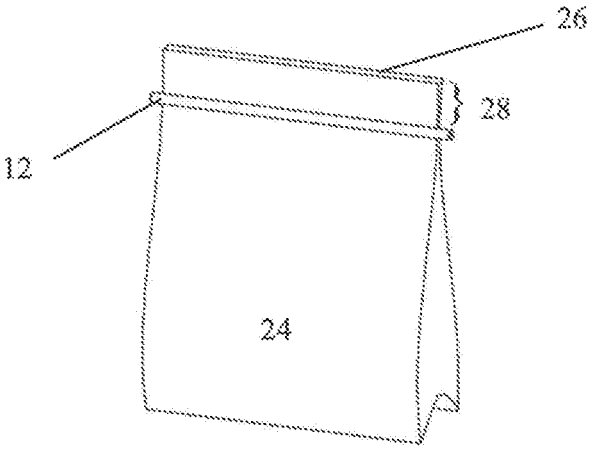
FIG. 4 illustrates the operation of the sealing apparatus illustrated in FIGS. 1 and 2, wherein a slide member of the sealing apparatus is placed proximate to and just below an unsealed end of a bag.
Figure 5:
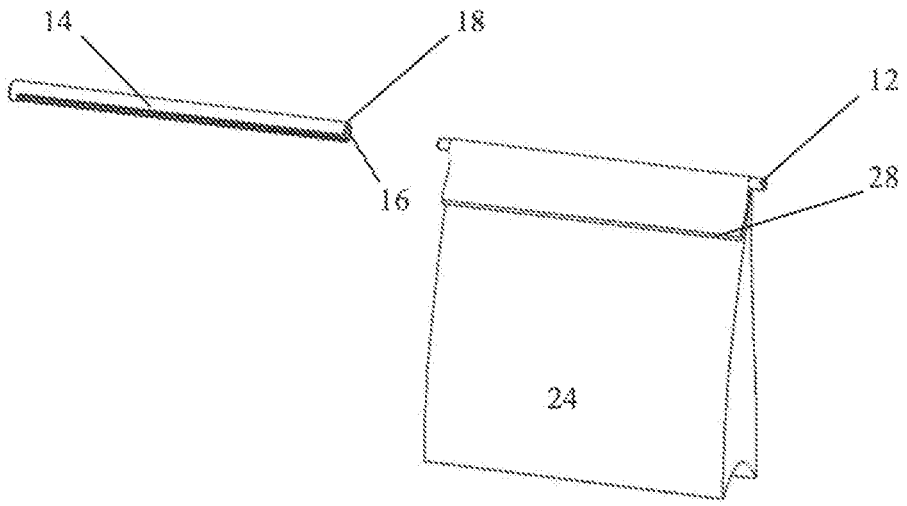
FIG. 5 illustrates the operation of the sealing apparatus illustrated in FIGS. 1 and 2, wherein an end portion of a bag is wrapped around a slide member of the sealing apparatus.
Figure 6:
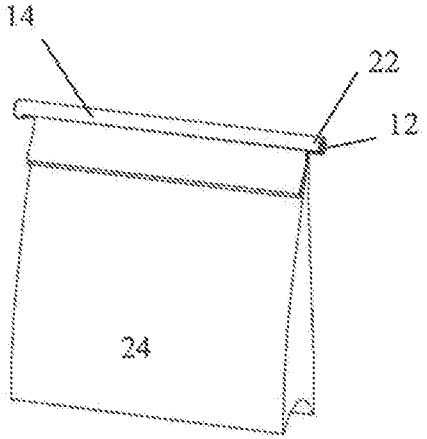
FIG. 6 illustrates the operation of the sealing apparatus illustrated in FIGS. 1 and 2, wherein a slide member is fully inserted into a retaining member of the sealing apparatus such that an end portion of a bag is captured to form a substantially air tight seal.

A method of operating the sealing apparatus 10 illustrated in FIGS. 1 and 2 and discussed above will now be described with reference to FIGS. 4-6. FIG. 4 illustrates a bag 24 having an unsealed end 26 that has been previously opened. As shown in the drawing, the slide member 12 is placed proximate to and just below the unsealed end 26 of the bag 24. An end portion 28 the bag 24 is then wrapped around the slide member 12 as shown in FIG. 5. Next, the slide member 12 is inserted into the retaining member 14 through the open end 18 of the retaining member 14 while the end portion 28 of the bag 24 remains wrapped around the slide member 12. As illustrated in FIG. 1, the open end 18 is preferably tapered or formed as a conical opening to help prevent the bag 24 from catching on the edge of the open end 18 as the slide member 12 is inserted into the retaining member. The slot 16 in the retaining member 14 provides clearance for the retaining member to pass over the end portion 28 of the bag 24 as the slide member 12 is inserted into the retaining member 14. The end portion 28 of the bag 24 is captured and retained between the slide member 12 and the retaining member 14 to form a substantially air tight seal when the slide member 12 is fully inserted into the retaining member 14 to abut the bottom stop 20 as shown in FIG. 6. The bag 24 is reopened simply by grasping the protruding portion 22 of the slide member 12 and pulling the slide member 12 out of the retaining member 14

Figure 7:
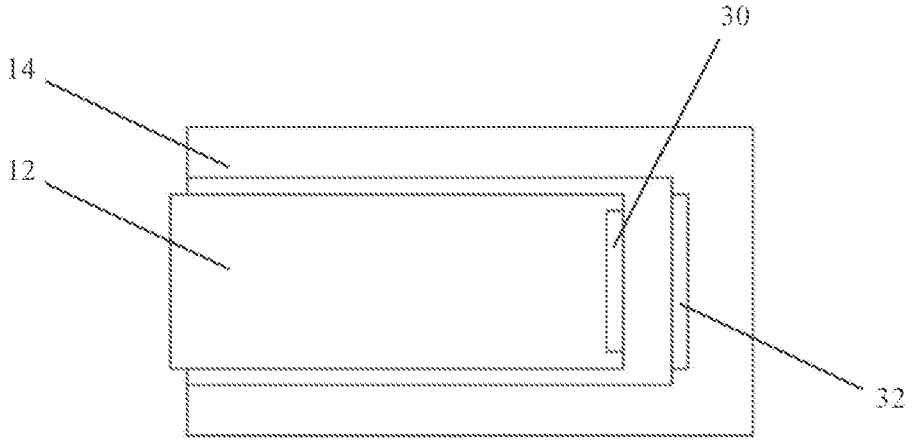
FIG. 7 illustrates a slide member of the sealing apparatus of FIGS. 1 and 2, wherein a slide member of the sealing apparatus includes a magnet provided on an end of the slide member intended to abut a bottom stop of a retaining member of the sealing apparatus to provide a releaseable engagement mechanism.

In some applications, it may be desirable to provide an engagement mechanism to releasably engage and hold the slide member 12 within the retaining member 14. FIG. 7, for example, illustrates a slide member 12 inserted within a retaining member 14 in which the slide member 12 includes a magnet 30 provided on an end of the slide member 12 intended to abut the bottom stop 20. In such a case, the bottom stop 20 may be composed of a magnetic material to which the magnet 30 is attracted or a magnetic receiver 32 made from a magnetic material is provided adjacent to the bottom stop 20 in the retaining member 14 to attract the magnet 30 as shown. As will be readily appreciated by those skilled in the art, the structure of the engagement mechanism may be readily reversed such that the magnet 30 is provided in the retaining mechanism 14 and the magnetic receiver 32 is provided at the end of the slide member 12. Still further, both the retaining member 14 and the slide member 12 may be provided with opposite pole attracting magnets.

Figure 8:
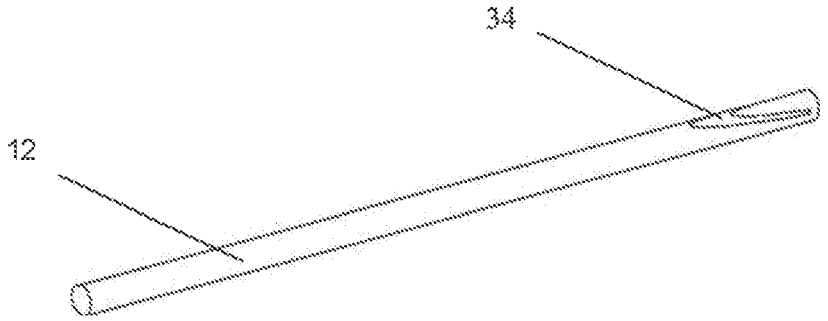
FIG. 8 illustrates a slide member of the sealing apparatus of FIG. 1 in which a retaining slot is provided in the seal member.

The sealing apparatus 10 can be manufactured in a variety of lengths to seal bags of different widths. In such cases, it may be desirable to provide a mechanism to help hold the end portion 28 of the bag 24 in place as it is wrapped around the slide member 12. FIG. 8 illustrates a further example in which a retaining mechanism in the form of a retaining slot 34 is cut into the slide member 12 at an angle, such that an edge of the end portion 28 can be inserted into the retaining slot 34 and held in place as the end portion 28 is wrapped around the slide member 12 and inserted into the retaining member 14. In the illustrated example, the retaining slot 34 is cut in an angle into the slide member 12 at one end of the slide member such that only an edge of the end portion 28 of the bag 24 is retained therein. In an alternate embodiment, the retaining slot 34 could be cut along the length of the slide member 12 such that the entire end portion 28 would be passed through the retaining slot 34. The slide member 12 would then be rotated to fold the end portion 28 over the slide member 12.

The sealing apparatus 10 provides many advantages over conventional sealing devices. For example, since no clamping, clipping or snapping is required by inserting the slide member 12 into the retaining member 14, the sealing apparatus 10 can be easily utilized by individuals lacking in manual dexterity. Further, the slide member 12 and the retaining member 14 are not subjected to substantial wear and degradation due to deformation and flexing of their structures. In the most basic form, the sealing apparatus 10 requires only two parts, the slide member 12 and the retaining member 14, which can be easily and inexpensively manufactured in high volume by processes including, but not limited to, injection molding and 3-D printing. No assembly of components is required by the sealing apparatus 10 further reducing manufacturing expenses. Still further, the shape and size of the sealing member 12 and the retaining member 14 make them easy to store either separately or together in kitchen drawers adapted to store utensils.

The invention has been described with reference to certain representative examples and embodiments. It will be readily understood by one of ordinary skill in the art, however, that modifications and variations are possible within the scope of the appended claims. For example, although the slide member is described as a cylindrical rod that fits with the hollow cylindrical shape of the retaining member, other shapes for both the slide member and retaining member may be utilized as long as the slide member can slide within an opening provided in the retaining member. Such shapes may include, but are not limited to, a slide member having a cross section of square, triangular, star, rectangular or other geometric shape that fits within a corresponding opening provided in the retaining member. Further, while the described slide member and receiving member are not required to be flexible or deformable, they may be readily made of such materials if so desired. The engagement mechanism may also take the form of a detent provided in one of the slide member and the retainer member or the sealing apparatus can be modified to receive a clip to hold the slide member within the retainer member. Still further, while the primary purpose of the sealing device is to seal an opening of a bag, it has been found that the sealing device may also perform another function of acting as a bag stand, wherein a portion of the side of a bag (instead of the open end) is retained by the retaining member and the sealing device is arranged to stand vertically beside the bag. Such examples of further illustrations, modifications and variations are not intended to limit the scope of the appended claims.

What is claimed is:

1. A sealing apparatus comprising:

a retaining member; and a slide member adapted to slide into the retaining member, wherein the retaining member includes:

an open end at a first end of the retaining member and a closed stop at a second end of the retaining member;

an elongated opening that extends through the open end of the retaining member; and a first magnetic member disposed on an inside surface of the closed stop of the retaining member, wherein the slide member includes:

a second magnetic member disposed at a first end of the slide member and configured to engage with the first magnetic member when the first end of the slide member is slid into the retaining member;

a protruding portion formed at a second end of the slide member and configured to protrude from the open end of the retaining member when the slide member is slid into and retained by the retaining member; and a retaining slot formed in a non-end portion of the slide member and configured to hold an edge of a package to be sealed by the sealing apparatus, wherein the first magnetic member and the second magnetic member form an engagement mechanism to releaseably couple the slide member to the retaining member when the slide member is slid into and retained by the retaining member.

* * * * *